US009037065B2

(12) United States Patent
Suzuki

(10) Patent No.: US 9,037,065 B2
(45) Date of Patent: May 19, 2015

(54) FOIL TRANSFERRING APPARATUS AND IMAGE FORMING SYSTEM USING THE SAME

(71) Applicant: Konica Minolta, Inc., Tokyo (JP)

(72) Inventor: Tomoo Suzuki, Tokyo (JP)

(73) Assignee: KONICA MINOLTA, INC. (JP)

( * ) Notice: Subject to any disclaimer, the term of this patent is extended or adjusted under 35 U.S.C. 154(b) by 132 days.

(21) Appl. No.: 13/869,382

(22) Filed: Apr. 24, 2013

(65) Prior Publication Data

US 2013/0287455 A1 Oct. 31, 2013

(30) Foreign Application Priority Data

Apr. 27, 2012 (JP) ..... 2012-103261
Mar. 27, 2013 (JP) ..... 2013-67456

(51) Int. Cl.
*G03G 15/20* (2006.01)
*G03G 15/16* (2006.01)
*G03G 13/16* (2006.01)
*G03G 15/00* (2006.01)

(52) U.S. Cl.
CPC ..... *G03G 15/16* (2013.01); *G03G 15/6582* (2013.01)

(58) Field of Classification Search
USPC ..... 399/297, 307, 341, 342; 430/126.1
See application file for complete search history.

(56) References Cited

U.S. PATENT DOCUMENTS

2011/0229819 A1* 9/2011 Hiramoto et al. ..... 430/124.13
2012/0028175 A1* 2/2012 Uchino et al. ..... 430/48
2012/0177417 A1* 7/2012 Fujita et al. ..... 399/297
2012/0251174 A1* 10/2012 Shirai et al. ..... 399/132
2013/0279952 A1* 10/2013 Suzuki ..... 399/297
2013/0308992 A1* 11/2013 Suzuki ..... 399/341

FOREIGN PATENT DOCUMENTS

JP 62-255184 A 11/1987
JP 63-286399 A 11/1988

* cited by examiner

*Primary Examiner* — Rodney Bonnette
(74) *Attorney, Agent, or Firm* — Cantor Colburn LLP

(57) ABSTRACT

In a first thermal transfer portion of upstream side, a negative toner image forming portion forms on a photosensitive drum a desired negative toner image which reverses a desired positive toner image selected from all the toner images. The negative toner image forming portion then forms the desired negative toner image on a belt member. The first thermal transfer portion transfers a desired negative foil image from a foil sheet to the belt member so that a desired positive foil image remains on the foil sheet. A second transfer portion transfers the desired positive foil image thus remained on the desired positive toner image formed on the sheet of paper. A cleaning portion removes the desired negative toner image and the desired negative foil image from the belt member.

20 Claims, 9 Drawing Sheets

500 (504)
504
502
6 6
510
512

500
510
512
502
504

500 (504)
504b 504a
504b
504a
504b 510
504c
512
504c
510
504c
6 6

500 (504)
504b
504a
504b
504a
504b
500
504
502
520
522
524
Star Beer
P
522
520
522
P 500
504a
(520)
504b
(522)
Star Beer
Pp
500
502
504
504a
522
520
504b
P 500 (504)
504b
500
504
502
504b P
504a
522
524
Star Beer
522
504a
520
522
P

FOIL TRANSFERRING APPARATUS AND IMAGE FORMING SYSTEM USING THE SAME

CROSS REFERENCE TO RELATED APPLICATION

The present invention claims priority under 35 U.S.C. §119 to Japanese Patent Application No. 2012-103261, filed Apr. 27, 2012, and Japanese Patent Application No. 2013-067456 filed Mar. 27, 2013, the entire contents of both of which are incorporated herein by reference.

BACKGROUND OF THE INVENTION

1. Field of the Invention

The present invention relates to a foil transferring apparatus and an image forming system using the same, in which a foil image is transferred on a desired toner image among all the toner images on the base material on which the images have been formed.

2. Description of Related Art

In a bookbinding field, a commercial printing field, a card business field or a plastic molding field such as cosmetic container, printing has been performed such that a character and/or a picture image made of foil are transferred to a sheet of paper in order to give metallic appearance or a high-quality glossy image to a product, which cannot be expressed merely by common printing.

In recent years, foil transferring technology has been utilized for anti-counterfeiting a cash card or a credit card and for a hologram provided for a security.

As the foil transferring technology, for example, Japanese Patent Application Publication No. S62-255184 discloses a simplified thermal transfer printing apparatus in which a foil sheet having a foil layer on a film base member is placed on base material having a toner image for electrostatic copying while the foil layer overlaps the toner image to each other and by applying any heat and pressure on them from above, the foil layer is transferred to the toner image.

Further, Japanese Patent Application Publication No. S63-286399 discloses a foil image forming method for forming the foil image. In this method, a toner image is formed on a sheet of paper, a color foil is applied thereto using a thermo compression bonding, and a foil image is transferred to supporting medium using the color foil from which a color layer of the portion contacting with the toner image is removed. Namely, in this foil image forming method, an foil image is formed by the following steps of: (1) A negative image in which an original image is reversed is copied to form a negative image copy; (2) Plastic foil for foil-stamping is stamped to the negative image copy using a thermo compression bonding; (3) By then separating them from each other, a color layer of a portion contacting with toner is adhered onto the negative image copy and remains thereon; (4) On the other hand, a positive image of the original image remains on the plastic foil for foil-stamping; and (5) The positive image of the original image is stamped to supporting medium such as polyvinyl chloride sheet using a thermo transfer printing.

SUMMARY OF THE INVENTION

In the foil transferring method of the thermal transfer printing apparatus disclosed in Japanese Patent Application Publication No. S62-255184, however, when any toner image(s) other than the above-mentioned desired toner image on which the foil image is to be transferred is (are) formed on the base material, the toner image(s) may be thermally fused to have a fusion function so as to allow the foil image(s), to be transferred, to adhere thereto, so that the foil images are not only transferred to the desired toner image but also other toner image(s) which has (have) already formed on the base material, for example, toner image such as a design image. In other words, the foil images may be transferred on all the toner images formed on the base material. As a result thereof, it is difficult to provide a foil transferring apparatus and an image forming system using the same in which only a desired target foil image is transferred.

Further, in the foil image forming method of Japanese Patent Application Publication No. S63-286399, when transferring the foil image on the base material, a printing method is adapted in which by separating the plastic foil for foil-stamping and the negative image copy from each other after the plastic foil for foil-stamping is stamped to the negative toner image using the thermo compression bonding, the color layer of the portion contacting with the negative toner image is adhered onto the negative image copy and remains thereon so that an extra portion of the foil is previously removed. However, in this method, a sheet of paper (hereinafter, referred to as "waste sheet") of larger size than that of the base material has been used to remove the negative foil image in order to prevent unnecessary foil from adhering to a margin of the base material.

Further, since the unnecessary foil is transferred on the waste sheet, the waste sheet has been discarded after it has been used for removing the foil image. This has resulted in wasteful paper resources.

Additionally, in a past image forming system, a step of forming a positive toner image on the sheet of paper and a step of forming a negative toner image on the waste sheet have been carried out, step by step, during foil transferring time in the image forming apparatus thereof. This causes a period of waiting time in the foil transferring apparatus to be extended. Such extension has been resulted in lengthening a period of foil transfer processing time in the whole system. Accordingly, it is difficult to perform any efficient foil transfer successively, which causes productivity in the image forming system to be deteriorated.

This invention addresses the above-mentioned issues and has an object to provide an improved foil transferring apparatus and an improved image forming system.

To achieve the above-mentioned object, a foil transferring apparatus reflecting one aspect of the present invention, which transfers a desired positive foil image on a desired positive toner image selected among all the toner images formed on base material, contains a negative toner image forming portion that includes a photosensitive drum and an image supporting member, the negative toner image forming portion forming a desired negative toner image that reverses the desired positive toner image on the photosensitive drum and transferring the desired negative toner image formed on the photosensitive drum onto the image supporting member, a supplying portion that supplies a foil sheet having a foil layer on a surface thereof to the negative toner image forming portion, a conveying path on which the foil sheet is conveyed, a first transfer portion that transfers a desired negative foil image from the foil sheet to the image supporting member, the first transfer portion being positioned at an upstream side of the conveying path, a second transfer portion that transfers a desired positive foil image remained on the foil sheet onto the desired positive toner image formed on the base material, the second transfer portion being positioned at a downstream side of the conveying path, and a cleaning portion that removes the desired negative toner image and the desired negative foil image from the image supporting member.

It is desirable to provide the foil transferring apparatus wherein the first transfer portion is a first thermal transfer portion and the second transfer portion is a second thermal transfer portion.

It is also desirable to provide the foil transferring apparatus wherein the negative toner image forming portion further includes a charging portion that charges the photosensitive drum with electricity, an exposing portion that forms a desired negative electrostatic latent image on the photosensitive drum charged by the charging portion, a developing portion that develops the desired negative electrostatic latent image formed on the photosensitive drum by the exposing portion to form the desired negative toner image, and a negative toner image transferring portion that transfers the desired negative toner image from the photosensitive drum to the image supporting portion.

It is still desirable to provide the foil transferring apparatus wherein the supplying portion contains a winding portion on which the foil sheet is wound like a roll, a reel portion that winds the foil sheet drawn out of the winding portion, and a driving portion that drives the reel portion.

It is further desirable to provide the foil transferring apparatus wherein the image supporting member is a belt member.

It is additionally desirable to provide the foil transferring apparatus further containing a manipulation/display portion that is configured so as to select a foil processing area for selecting the desired positive toner image on which the desired positive foil image is transferred among all the images formed on the base material.

It is still further desirable to provide the foil transferring apparatus further containing a control portion that is configured so as to convey the foil sheet and the base material to the second transfer portion to align the desired positive foil image on the foil sheet with the desired positive toner image on the base material.

It is still additionally desirable to provide the foil transferring apparatus further containing registration rollers that move to a width direction of the base material with the base material being nipped, wherein the control portion controls the registration rollers to correct a deviation amount of a position of an end of the base material deviated from a reference position by moving the registration rollers so that the desired positive toner image on the base material is aligned with the desired positive foil image on the foil sheet.

It is further desirable to provide the foil transferring apparatus further containing a manipulation/display portion that is configured so as to set an image relating to a foil processing area in which the foil is transferred onto the image selected among all the images.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe preferred embodiments of a foil transferring apparatus and an image forming system using the same relating to the invention with reference to drawings. It is to be noted that the description in the embodiments is exemplified and any technical scope of the claims and/or meaning of term(s) claimed in the claims are not limited thereto.

[Configuration Example of Image Forming System]

Figure 1:
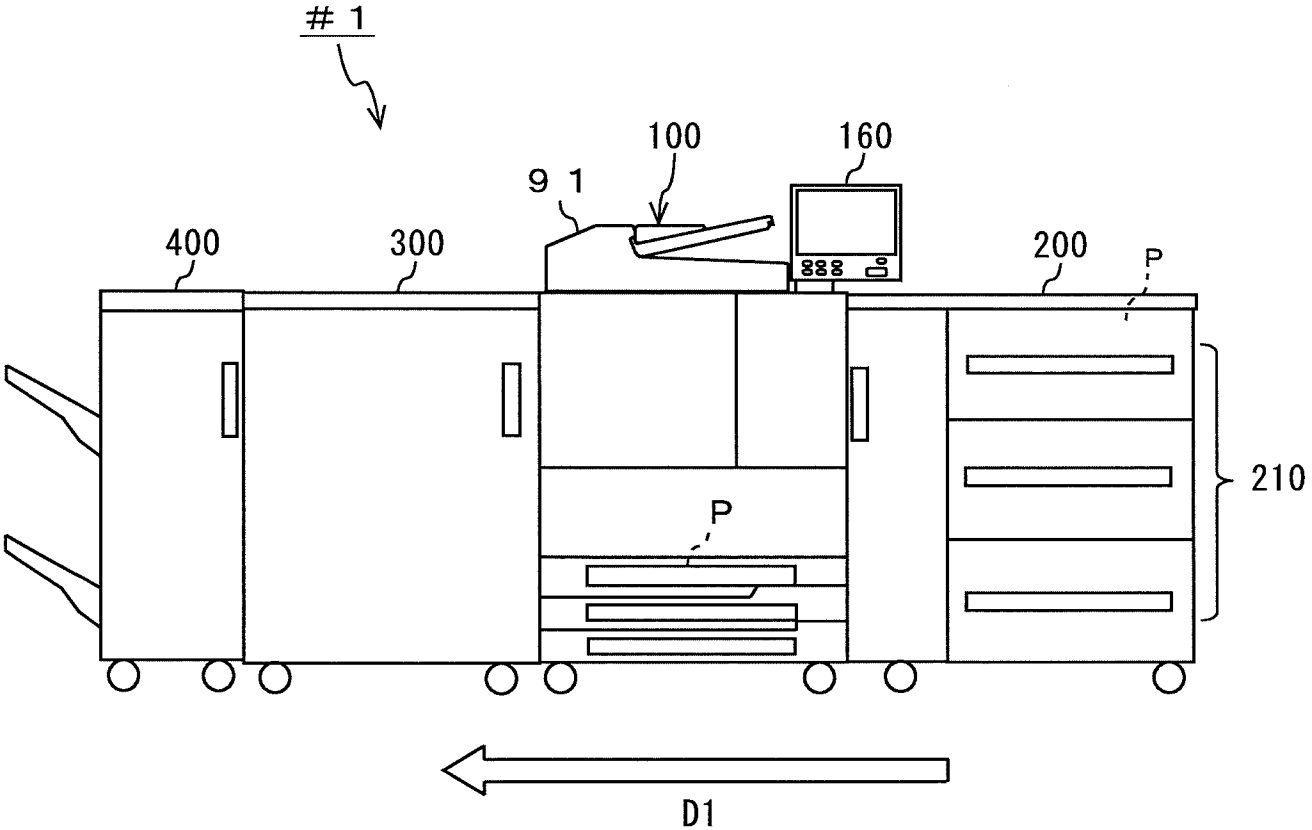
FIG. 1 is a diagram of an image forming system #1 according to an embodiment of this invention showing a configuration example thereof.

First, the following will describe an embodiment of the image forming system #1 relating to the invention with reference to FIG. 1. It is to be noted that a size and a ratio in each of the drawings including FIG. 1 are exaggerated for convenience of explanation and the ratio may be different from the actual one.

As shown in FIG. 1, the image forming system #1 according to the invention is provided with an image forming apparatus 100, a feeder 200, the foil transferring apparatus 300 and a finisher 400. The image forming system #1 rapidly and successively transfers a desired positive foil image on a desired positive toner image of a sheet of paper P with high accuracy. In FIG. 1, a sign, "D1" indicates a sheet-conveying direction.

The feeder 200 connects the image forming apparatus 100 at an upstream side along the sheet-conveying direction D1 of the sheet of paper P. The feeder 200 contains plural feeding trays 210, each containing sheets of paper P. The feeder 200 feeds the sheets of paper P one by one from a feeding tray 210 which contains user's specified sheets of paper while they are separated by a fan, an absorption conveying portion and the like. The feeder 200 conveys the fed sheet of paper P to the image forming apparatus 100 through the conveying rollers. It is to be noted that although one feeder 200 has been used in this embodiment, the invention is not limited thereto: more than one feeder 200 may be connected.

The image forming apparatus 100 connects the feeder 200 at a downstream side along the sheet-conveying direction D1 of the sheet of paper P. The image forming apparatus 100 forms all the toner images on the sheet of paper P that is fed from the feeder 200 or the like. The image forming apparatus 100 also forms all the toner images on the sheet of paper P, which is fed from a feeding portion 20 (see FIG. 2) in the image forming apparatus 100. The image forming apparatus 100 will be described more in detail later.

The image forming apparatus 100 is also provided with a manipulation/display portion 160 for allowing a user to set various kinds of conditions about foil transfer processing. The manipulation/display portion 160 is positioned on a case body of the image forming apparatus 100. The manipulation/display portion 160 includes a touch panel composed of, for example, liquid crystal display (LCD) and hard keys positioned on a periphery of the touch panel such as numeral buttons and a printing start button and the like.

The foil transferring apparatus 300 connects the image forming apparatus 100 at a downstream side along the sheet-conveying direction D1 of the sheet of paper P. The foil transferring apparatus 300 rapidly and successively transfers a desired positive foil image on a desired positive toner image selected among the all the toner images on the sheet of paper P with high accuracy. For example, the foil transferring apparatus 300 forms a desired negative toner image which reverses the desired positive toner image selected among all the toner images formed on the sheet of paper P onto a belt member 66 as an image supporting member. The foil transferring apparatus 300 then transfers a desired negative foil image from a foil sheet having a foil layer on a surface thereof onto the belt member 66. The foil transferring apparatus 300 then transfers a desired positive foil image remained on the foil sheet onto the desired positive toner image of the sheet of paper P. The sheet of paper P on which the foil image has been transferred is conveyed to the following finisher 400. The foil transferring apparatus 300 will be described more in detail later with reference to FIG. 6.

The finisher 400 connects the foil transferring apparatus 300 at a downstream side along the sheet-conveying direction D1 of the sheet of paper P. The finisher 400 performs any finisher processing such as stable-binding processing, folding processing, Z-folding processing, and booklet trimming on the sheet of paper P conveyed from the foil transferring apparatus 300 or the image forming apparatus 100.

[Configuration Example of Image Forming Apparatus 100]

Figure 2:
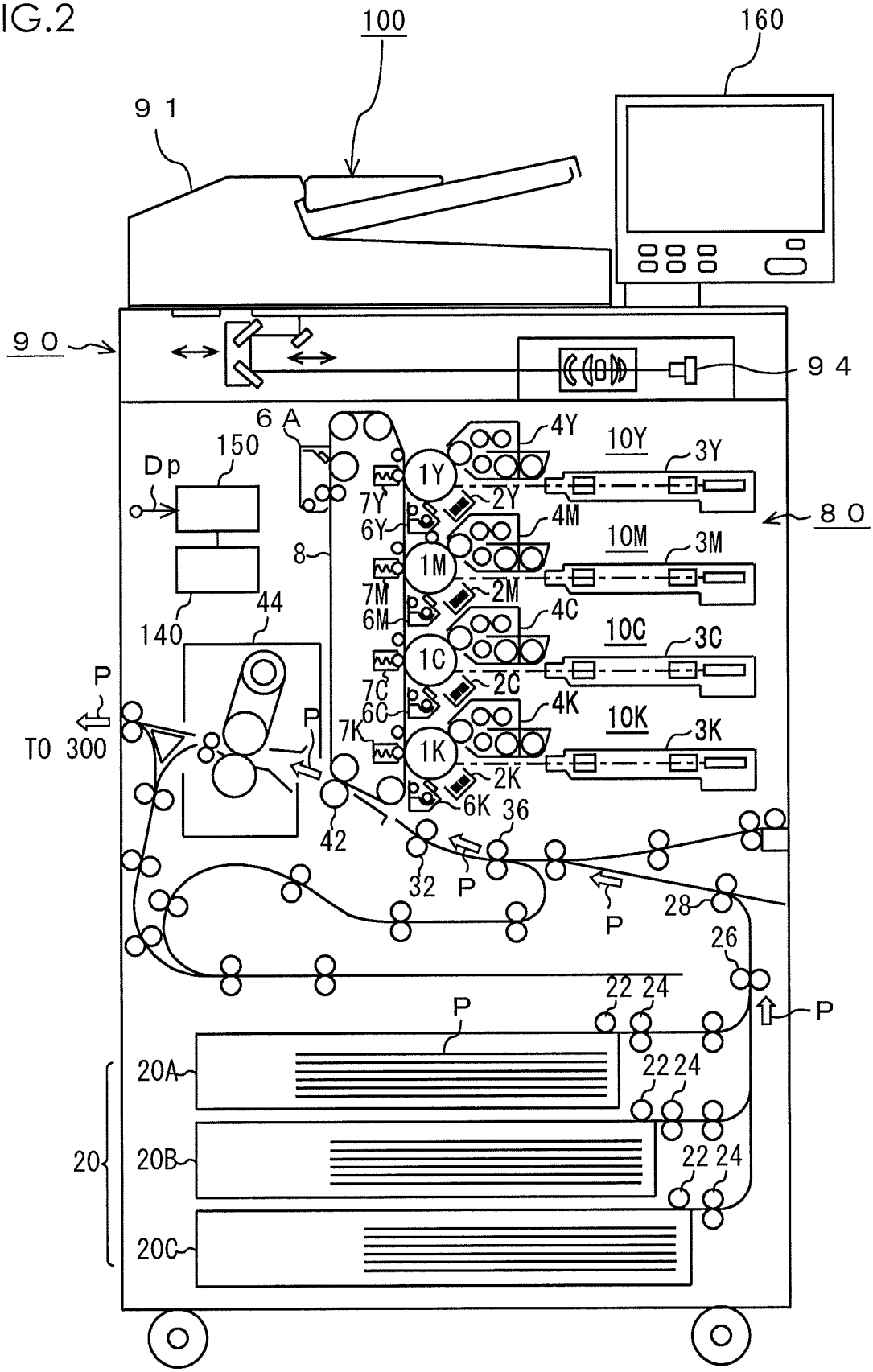
FIG. 2 is a diagram of an image forming apparatus 100 showing a configuration example thereof.

The following will describe a configuration example of the image forming apparatus 100 with reference to FIG. 2. The image forming apparatus 100 shown in FIG. 2 is referred to as "tandem-typed color image forming apparatus". The image forming apparatus 100 contains the feeding portion 20, a fixing portion 44, an electrophotographic image forming portion 80, an image reading portion 90, a control portion 150, an image processing portion 140, the manipulation/display portion 160 and an automatic document feeding portion 91. The automatic document feeding portion 91 is provided on the image forming apparatus 100.

The control portion 150 has, for example, a central processing unit (CPU). The control portion 150 controls operations of respective portions of the image forming apparatus 100, and controls a control portion 350 (see FIG. 7) or the like of the foil transferring apparatus 300 connecting the image forming apparatus 100 to perform any desired foil transfer processing together with the foil transferring apparatus 300.

The image reading portion 90 irradiates light from a source of light onto the documents or the like conveyed from the automatic document feeding portion 91 one by one and receives reflected light using a charge-couple device (CCD) image sensor 94 to obtain image data D of the documents or the like. The image processing portion 140 performs various kinds of processing such as analog processing, analog/digital (A/D) conversion, compression and the like on the image data D obtained by the image reading portion 90.

The manipulation/display portion 160 displays a selection screen for setting of a species of the sheet of paper P to be used as base material and for selecting setting of image data Dp of foil processing area on which the foil is transferred among all the items of image data D. The manipulation/display portion 160 also allows the user to set the species of the sheet of paper P and select the foil processing area. It is to be noted that the manipulation/display portion 160 may be installed in the foil transferring apparatus 300. A method how to select the foil processing area among all the items of image data D is performed by, for example, using any setting of an attribute of the image data D such as character, representation, graphic and the like, or using any setting based on the selection of the foil processing area by inputting coordinates.

Figure 7:
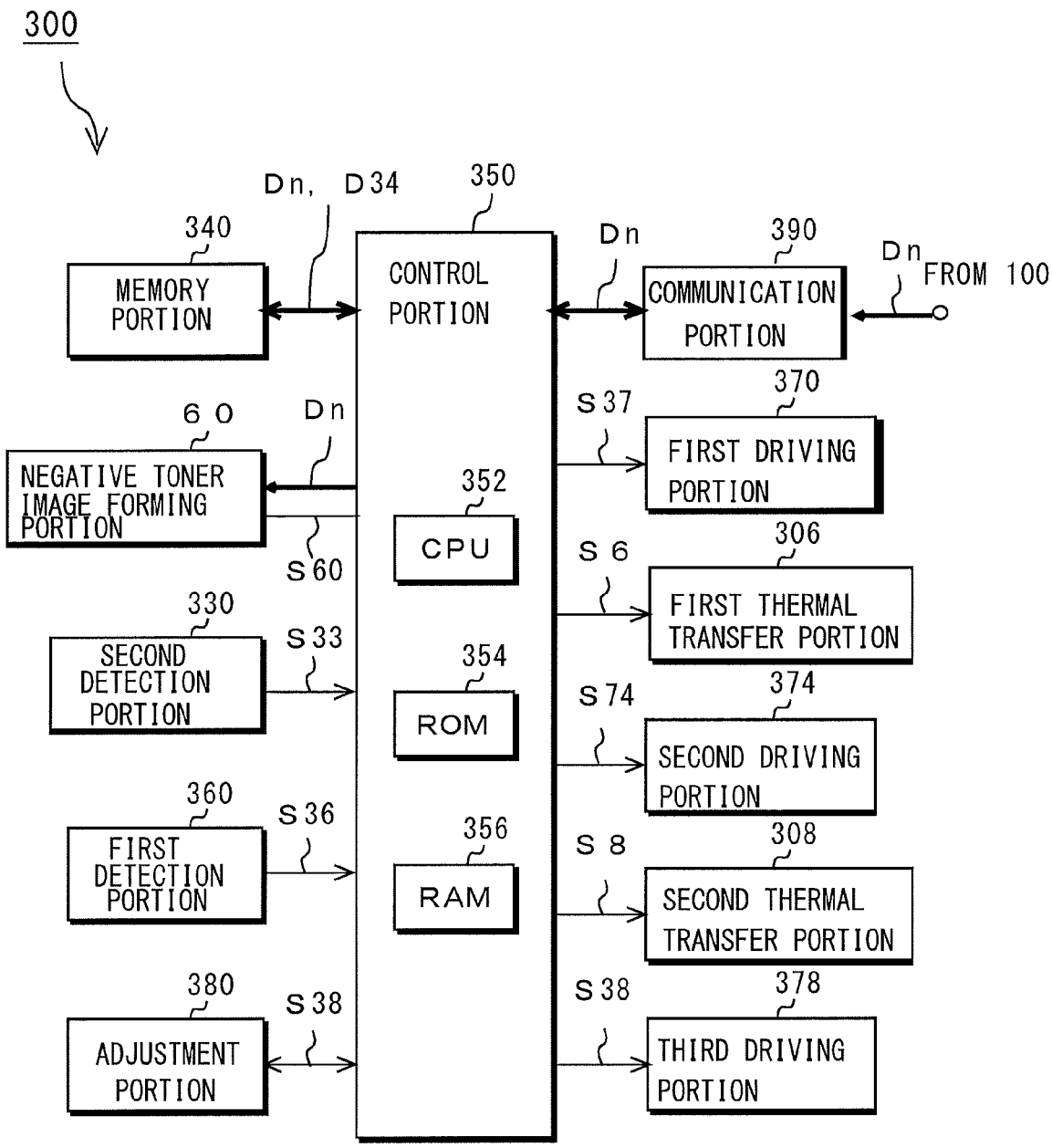
FIG. 7 is a block diagram of a control system of the foil transferring apparatus 300 showing a configuration example thereof.

The image processing portion 140 forms desired negative toner image data Dn which reverses desired positive toner image data Dp corresponding to the selected foil processing area among items of image data D and outputs the desired negative toner image data Dn to the foil transferring apparatus 300 (see FIG. 7).

The image forming portion 80 performs color conversion from all the image data D of RGB system to all the image data Db of YMCK system. The image forming portion 80 forms all the color toner images based on the image data for color-converted yellow (Y), magenta (M), cyan (C) and black (BK). The image forming portion 80 includes an image forming unit 10Y which forms a yellow (Y) image, an image forming unit 10M which forms a magenta (M) image, an image forming unit 10C which forms a cyan (C) image and an image forming unit 10K which forms a black (BK) image. In this embodiment, the following will describe the members having the common color function or name with attaching Y, M, C and K thereto.

The charging portions 2 corresponding to respective image colors uniformly charge surfaces of the photosensitive drums 1. The light-writing portions 3 each using a polygon mirror system form electrostatic latent images on the photosensitive drums 1 based on the image data Db. A writing start position of the image data Db on each of the photosensitive drums 1 is informed to the foil transferring apparatus 300. The developing portions 4 corresponding to respective colors develop the electrostatic latent images. Such charge, exposure and development enables the color toner images formed on the photosensitive drums 1 to be transferred on an intermediate transfer belt 8 (primary transfer) by primary transfer rollers 7 corresponding to each of the photosensitive drums 1 for Y, M, C, K colors. Respective color toner images are transferred on the intermediate transfer belt 8 and placed one another.

Secondary transfer portion 42 transfers the placed color toner images on the sheet of paper P (secondary transfer). The feeding portion 20 feeds the sheet of paper P from a feeding tray 20A, 20B or 20C or the like and the sheet of paper P is conveyed to the secondary transfer portion 42. Each feeding tray 20A, 20B or 20C contains sheets of paper P of a predetermined size. Each feeding tray 20A, 20B or 20C is provided with pick-up rollers 22 for feeding the sheet of paper P from each of the feeding trays and handling rollers 24 for preventing a multiple of sheets of paper P from being sent from each feeding tray.

The feeding portion 20 feeds the sheet of paper P from the feeding tray selected on the manipulation/display portion 160 or the like using the pick-up rollers 22 and the like and conveys the fed sheet of paper P to registration rollers 32 via the conveying rollers 26, 28, 36 and the like.

The registration rollers 32 correct a deflection of the sheet of conveyed paper P by hitting a forward end of the sheet of paper P thereto.

When finishing the correction of deflection of the sheet of conveyed paper P, the sheet of paper P is conveyed to the secondary transfer rollers 42 at a predetermined timing. The secondary transfer rollers 42 transfer the color toner image supported by the intermediate transfer belt 8 on the sheet of paper P. The fixing portion 44 fixes the color toner image transferred on the sheet of paper P. The fixing portion 44 contains a pressure roller, a heating roller and the like. The fixing portion 44 fixes the color toner image transferred on the sheet of paper P by applying pressure and heat to the sheet of paper P via the pressure roller and the heating roller. This enables the color toner image based on the image data Db to be formed on the sheet of paper P.

It is to be noted that cleaning portions 6 corresponding to the photosensitive drums 1 for Y, M, C, K colors are provided at left lower portions of the above-mentioned respective photosensitive drums 1. The cleaning portions 6 remove any toners, which remain on the photosensitive drums 1 at former image forming time, from the photosensitive drums 1 and clean them. A cleaning portion 6A is provided at a left upper portion of the intermediate transfer belt 8. The cleaning portion 6A cleans any toners, which remain on the intermediate transfer belt 8 after the secondary transfer.

[Configuration Example of Foil Sheet 500]

Figure 3A:
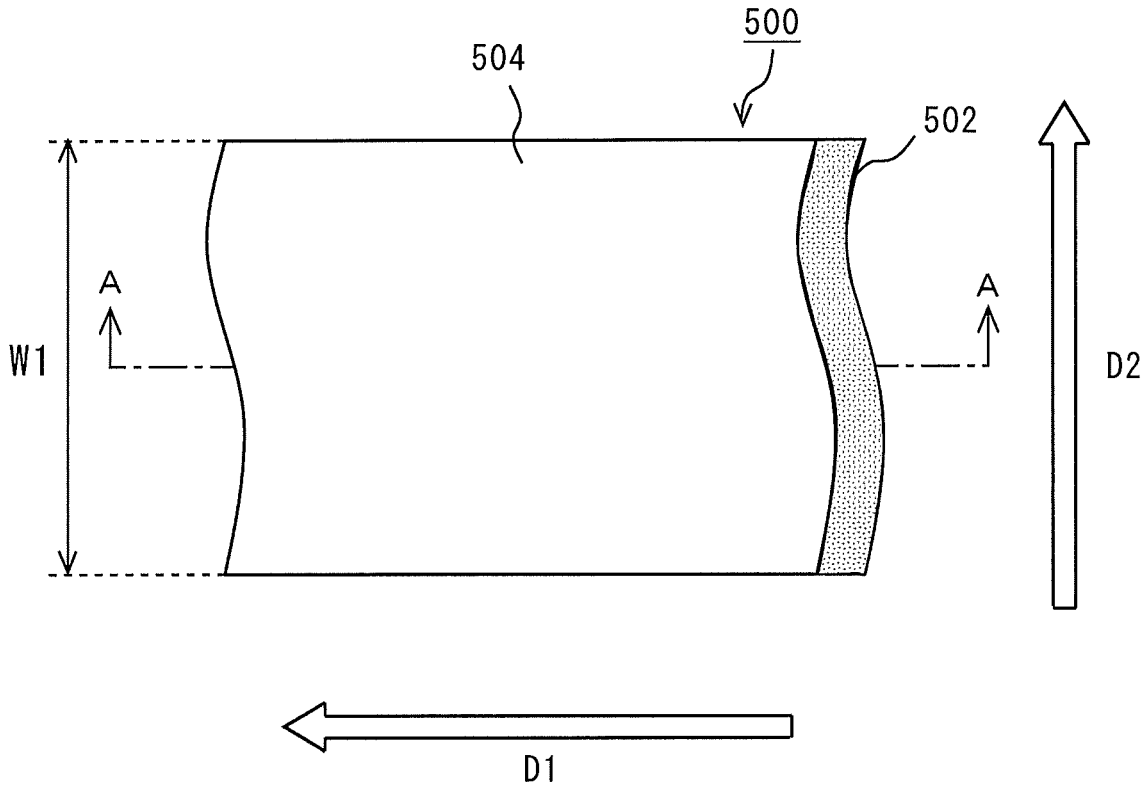
FIG. 3A is a plane view of a foil sheet 500 showing a configuration example thereof and FIG. 3B is a sectional view thereof, taken along lines A-A.
Figure 3B:
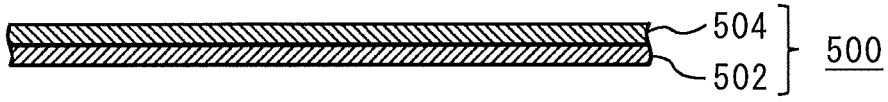

The follow will describe a configuration example of the foil sheet 500 with reference to FIGS. 3A and 3B. The foil sheet 500 shown in FIG. 3A is a long sheet which has a width W1, for example. As shown in FIG. 3B, it is composed of base member 502 and a foil layer 504. The base member 502 is made of transparent film of heat-resisting resin.

The foil layer 504 is formed on the base member 502. The foil layer 504 is formed by depositing, for example, aluminum on the base member 502 so that the foil layer 504 and the base member 502 are connected to each other by van der Waals force. When a width of belt member 66 is W2 and a width of the sheet of paper P is W3, a relationship of W3<W1<W1 is set (see FIGS. 3A through 5B).

[Transferred Example of Desired Negative Toner Image on Belt Member]

Next, the following will describe a transferred example of desired negative toner image on the belt member 66 on which desired negative foil image, to be not printed, is transferred. It is to be noted that in the following description, a case where a desired positive foil image, to be transferred on the sheet of paper P on which images have been formed, is a star image will be described.

Figure 4A:
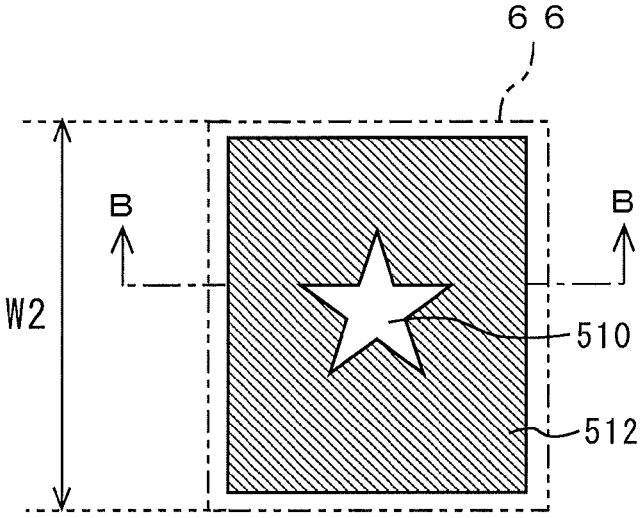
FIG. 4A is a plane view of a belt member 66 on which a desired negative toner image is transferred and FIG. 4B is a sectional view thereof, taken along lines B-B.
Figure 6:
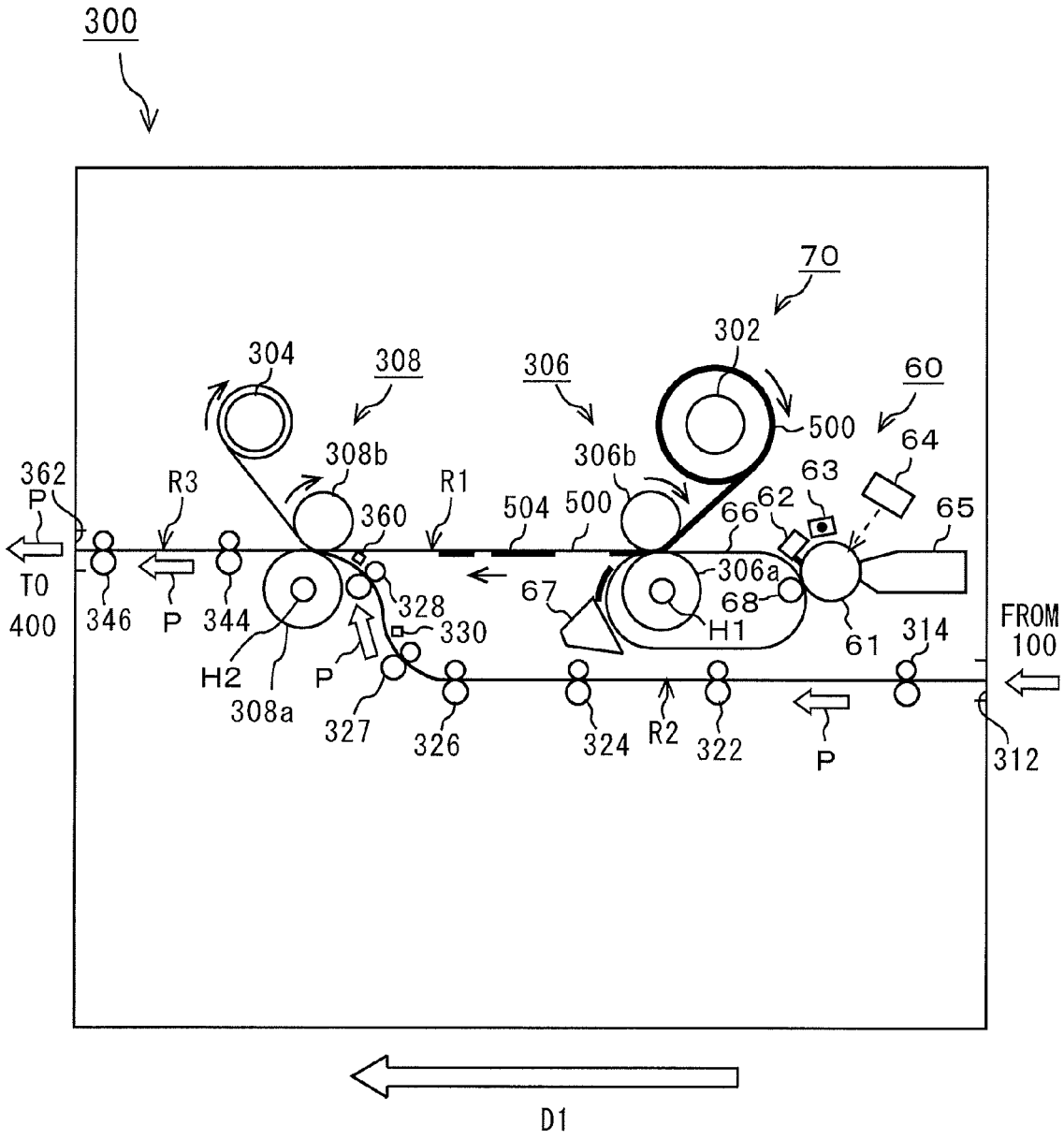
FIG. 6 is a sectional view of a foil transferring apparatus 300 according to an embodiment of this invention showing a configuration example thereof.

A negative toner image forming portion 60 shown in FIG. 6 forms the desired negative toner image 512, as shown in FIG. 4A, on the belt member 66 via a photosensitive drum 61. On the other hand, since an area of the star image is transferred on the desired positive toner image 520 having the star image of the sheet of paper P, the area becomes a recessed portion 510 from which the star image is removed. No toner image is transferred on this area so that the desired positive foil image of the star image remains on the foil sheet 500. Accordingly, the recessed portion 510 has the same size as that of the desired positive foil image 512.

[Transferred Example of Desired Positive Toner Image on Sheet of Paper P]

Figure 5A:
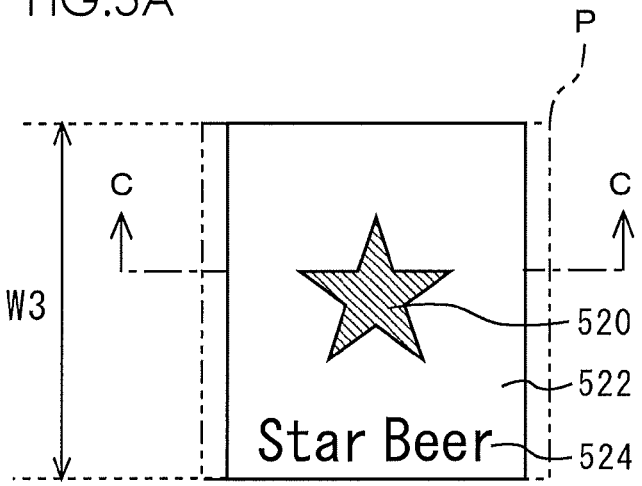
FIG. 5A is a plane view of a sheet of paper P on which a desired positive toner mage is transferred and FIG. 5B is a sectional view thereof, taken along lines C-C.

The follow will describe a transferred example of the desired positive toner image 520 on the sheet of paper P. As shown in FIG. 5A, in the sheet of paper P on which the images have been formed, the desired positive toner image 520 of star image that has the same size as that of the desired positive foil image, to be printed, is formed on an almost middle area of the sheet of paper P, on which the desired positive foil image of the star image is transferred.

On the other hand, an area corresponding to the desired negative foil image excluding the star image which is transferred on the sheet of paper P becomes a portion 522 of the sheet of paper P, on which no toner image is transferred. This portion 522 reverses the star image. In this embodiment, a toner image 524 of characters, "Star Beer" is previously formed as a design image below the desired positive toner image 520 within a region of the portion 522.

Figure 5B:
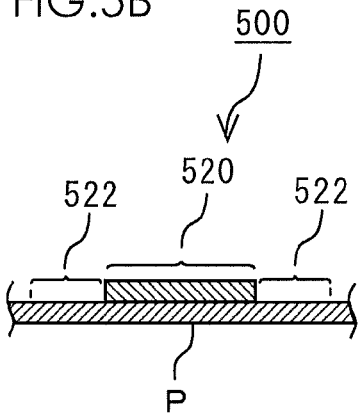

The sheet of paper P has the width W3 which is smaller than the width W1 of the foil sheet 500 and the width W2 of the belt member 66 in this embodiment so that the foil image is transferred on the sheet of paper P having the smaller size than the widths W1 and W2. Thus, in this embodiment, in order to transfer the desired positive foil image of the star image on the desired positive toner image of the star image of the sheet of paper P, it is configured that a portion of the desired positive foil image corresponding to the star image as shown in FIGS. 5A and 5B remains on the foil sheet 500 shown in FIGS. 3A and 3B.

[Configuration Example of Foil Transferring Apparatus 300]

The following will describe the foil transferring apparatus 300 with reference to FIG. 6. As shown in FIG. 6, the foil transferring apparatus 300 is provided with the negative toner image forming portion 60, a supplying portion 70, conveying paths R1, R2, a paper ejection path R3, a first thermal transfer portion 306, a second thermal transfer portion 308, a second detection portion 330 and a first detection portion 360. The foil transferring apparatus 300 transfers a desired positive foil image on a desired positive toner image of the sheet of paper P.

The supplying portion 70 includes a winding portion 302, a reel portion 304 and a first driving portion 370 (see FIG. 7). The supplying portion 70 supplies the foil sheet 500 having a foil layer 504 on a surface thereof, as shown in FIGS. 3A and 3B, to the negative toner image forming portion 60. The winding portion 302 winds the foil sheet 500 around it into a roll. The winding portion 302 is positioned at an upstream side (a side of an entrance 312) along the sheet-conveying direction D1 of the sheet of paper P. The winding portion 302 is composed of, for example, a reel and a cartridge. The winding portion 302 is supported by an axis portion thereof, not shown, so as to be able to rotate.

In order to reel in the foil sheet 500 drawn out of the winding portion 302, the reel portion 304 is positioned at a downstream side (a side of an exit 362) along the sheet-conveying direction D1 of the sheet of paper P so as to be away from the winding portion 302 by a predetermined distance. The reel portion 304 includes a reel and is supported by an axis portion thereof, not shown, so as to be able to rotate. In this embodiment, the reel portion 304 is positioned at a level that is almost the same level as that of the winding portion 302. One end of the foil sheet 500 wound on the winding portion 302 is attached to the reel portion 304 so that it is stretched via the nip portions of the first and second thermal transfer portions 306, 308, which will be described later.

The reel portion 304 connects the first driving portion 370 for driving a transfer roller (see FIG. 7). The first driving portion 370 drives the reel portion 304 so as to rotate together with the second thermal transfer portion 308. When the reel portion 304 rotates, the foil sheet 500 set on the winding portion 302 is conveyed so as to pass through the first thermal transfer portion 306 and the second thermal transfer portion 308. The foil sheet 500 is then wound on the reel portion 304.

In this embodiment, a conveying path between the winding portion 302 and the reel portion 304 is referred to as the "conveying path R1" of the foil sheet 500. The conveying path R1 constitutes a path on which the positive foil image remained on the foil sheet 500 is conveyed from the first thermal transfer portion 306 to the second thermal transfer portion 308.

The negative toner image forming portion 60 is provided under the upstream side of the conveying path R1. The negative toner image forming portion 60 contains the photosensitive drum 61. A cleaning portion 62, a charging portion 63, an exposing portion 64 and a developing portion 65 are positioned clockwise around the photosensitive drum 61 one by one. The endless belt member 66 constituting the image supporting member contacts the photosensitive drum 61 between the cleaning portion 62 and the developing portion 65 so as to be slidable. The belt member 66 is made of, for example, polyimide resin and any silicon coating is performed on a surface of the belt using coating material of silicon system to improve release characteristics thereof.

In this embodiment, the photosensitive drum 61 is provided at a predetermined position of the negative toner image forming portion 60. On the photosensitive drum 61, the desired negative toner image of the sheet of paper P, for example, the desired negative toner image which reverses the star image, as shown in FIG. 4A, is formed. The photosensitive drum 61 may be made of the same material as that of each of the photosensitive drums 1 of the image forming apparatus 100.

The following will describe a formation of the desired negative toner image by the negative toner image forming portion 60. The charging portion 63 charges the photosensitive drum 61 at a predetermined electric potential. The exposing portion 64 exposes the photosensitive drum 61 charged by the charging portion 63 based on the image data Dn, so that a desired negative electrostatic latent image is formed. For example, the image data Dn is desired negative toner image data which reverses the desired positive toner image data Dp of star image (see FIG. 4A).

The developing portion 65 positioned at downstream side of the exposing portion 64 develops the desired negative electrostatic latent image on the photosensitive drum 61. Next, a negative toner transferring portion 68 transfers the desired negative toner image from the photosensitive drum 61 to the belt member 66. The cleaning portion 62 removes the toner remained on the photosensitive drum 61 after the transfer thereof.

The first thermal transfer portion 306 constituting a first transfer portion is positioned at an upstream side of the conveying path R1 of the foil sheet 500 supplied from the supplying portion 70. The first thermal transfer portion 306 transfers the desired negative foil image from the foil sheet 500 onto the belt member 66 using a fusion action of the toner (see FIG. 4A). In other words, the first thermal transfer portion 306 heats and pressures the toner image so that its property is changed to have adhesive properties. The toner image thus adheres to the foil layer 504 of foil sheet 500, which removes the foil layer 504 from the foil sheet 500 so that the foil layer 504 is transferred on the belt member 66.

The first thermal transfer portion 306 contains, for example, a first heating roller 306*a* including a heater H1 and a first pressure roller 306*b* arranged so as to face the first heating roller 306*a*. The first thermal transfer portion 306 lays the foil layer 504 of the foil sheet 500 over the desired negative toner image supported on the belt member 66. The first thermal transfer portion 306 then heats and pressures them so that the foil layer 504 adheres to the desired negative toner image and the negative foil image is transferred on the belt member 66. It is to be noted that the heating temperature is preferably about 100° C., for example.

The belt member 66 on which the desired negative foil image is transferred by the first thermal transfer portion 306 is conveyed to a cleaning portion 67. The cleaning portion 67 is provided at a downstream side of the belt member 66 and includes a scraper, a blade, a pad and the like for cleaning. The scraper removes the desired negative toner image and the desired negative foil image which has adhered to the desired negative toner image from the belt member 66 without doing damage to a surface of the belt member. The negative toner image forming portion 60 enters into a next transferring cycle of the desired negative toner image.

The conveying path R2 is provided below the above-mentioned conveying path R1. The conveying path R2 is composed of, for example, a pair of guide plates. The conveying path R2 extends from the entrance 312 of the foil transferring apparatus 300 to the second thermal transfer portion 308. Plural conveying rollers 314, 322, 324 and 326 and loop rollers 327 are positioned on the conveying path R2. The sheet of image-formed paper P which is conveyed from the image forming apparatus 100 through the entrance 312 is conveyed to the registration rollers 328 by the conveying rollers 314, 322, 324 and 326 and the loop rollers 327.

The second thermal transfer portion 308 constituting a second transfer portion is positioned at a downstream side of the conveying path R1 of the foil sheet 500 and at a downstream side of conveying path R2 of the sheet of paper P. The second thermal transfer portion 308 transfers on the desired positive toner image the desired positive foil image remained on the foil sheet 500 by transferring the desired negative foil image on the belt member 66 with the first thermal transfer portion 306. The second thermal transfer portion 308 contains, for example, a second heating roller 308*a* including a heater H2 and a second pressure roller 308*b* arranged so as to face the second heating roller 308*a*.

The second thermal transfer portion 308 receives the sheet of paper P from the registration rollers 328 at a predetermined timing. The second thermal transfer portion 308 lays the desired positive foil image remained on the foil sheet 500 over a surface of the sheet of paper on which the desired positive toner image is transferred. The second thermal transfer portion 308 then heats and pressures them so that the desired positive foil image is transferred onto the positive toner image of the sheet of paper P. It is to be noted that the heating temperature is preferably about 100° C., for example.

The paper ejection path R3 is provided at a downstream side of the second thermal transfer portion 308. The paper ejection path R3 includes plural conveying rollers 344, 346. The paper ejection path R3 conveys the sheet of paper P on which the second thermal transfer portion 308 transfers the foil image to the exit 362 by the conveying rollers 344 and 346. The paper ejection path R3 is composed of, for example, a pair of guide plates. The paper ejection path R3 extends from the second thermal transfer portion 308 to the exit 362 horizontally.

The second detection portion 330 is positioned between the loop rollers 327 and the registration rollers 328. The second detection portion 330 detects a forward end of the sheet of paper P on which the images have been formed when correcting any deflection of the sheet of paper P (registration correction) and outputs a sheet detection signal S33 indicating whether or not the sheet of paper P reaches. For the second detection portion 330, a sensor of reflection type or transmission type is used.

The first detection portion 360 is positioned at a downstream side of the registration rollers 328 along the sheet-conveying direction D1 of the sheet of paper P. The first detection portion 360 is composed of a line sensor in which photoelectric transducers are arranged so as to be lined or an image sensor in which photoelectric transducers are arranged like a matrix. The first detection portion 360 detects a position of a side of the sheet of paper P and outputs a detection signal S36 indicating an amount of deviation from a reference position of the sheet of paper P. The reference position is set on the basis of a position of a side of the foil sheet 500.

The loop rollers 327 are positioned at an upstream side of the second thermal transfer portion 308 along the sheet-conveying direction D1 of the sheet of paper P. The registration rollers 328 are positioned at a downstream side of the loop rollers 327 along the sheet-conveying direction D1 of the sheet of paper P. The loop rollers 327 corrects the deflection of the sheet of paper P, when performing the registration correction, by hitting a forward end of the sheet of paper P against the registration rollers 328 to form a loop.

After the registration correction is finished, the registration rollers 328 performs a registration fluctuation correction to move the sheet of paper P along a width direction D2 of the sheet of paper P by a deflection distance, which is a difference between the position of the side of the sheet of paper P and the reference position, with the sheet of paper P being nipped. The width direction D2 is a direction that is perpendicular to the conveying direction D1 and is also a width direction of the sheet of paper P (see FIG. 3A). Such registration fluctuation correction enables the desired positive foil image remained on the foil sheet 500 to be aligned with the desired positive toner image of sheet of paper P on which the images have been formed.

The registration rollers 328 convey the sheet of paper P to the second thermal transfer portion 308 to meet the time when the foil sheet 500, on which the desired positive foil image remains, reaches the second thermal transfer portion 308 after the registration fluctuation correction has been completed. The registration rollers 328 release the nipping of the sheet of paper P and return to their previously set home positions when the movement of the sheet of paper P has been completed.

[Configuration Example of Control System of Foil Transferring Apparatus 300]

The following will describe a configuration example of a control system of the foil transferring apparatus 300. As shown in FIG. 7, the foil transferring apparatus 300 contains, for example, a control portion 350 that controls operations of respective portions of the foil transferring apparatus 300 based on instructions from a control portion 150 of the image forming apparatus 100 as a master thereof. The control portion 350 includes a central processing unit (CPU) 352 to perform any programs for foil transfer processing, a read only memory (ROM) 345 to store control programs or the like and a random access memory (RAM) 356 to store data temporarily.

The control portion 350 connects the negative toner image forming portion 60, the first thermal transfer portion 306, the second thermal transfer portion 308, the second detection portion 330, the first detection portion 360, an adjustment portion 380, the first driving portion 370, the second driving portion 374, a third driving portion 378, a memory portion 340 and a communication portion 390, respectively. The negative toner image forming portion 60 forms the desired negative toner image on the photosensitive drum 61, for example, the desired negative toner image, shown in FIG. 4A, which reverses the star image, based on an image forming signal S60 and the image data Dn.

The negative toner image forming portion 60 charges the photosensitive drum 61 at predetermined electric potential based on the image forming signal S60. The electrostatic latent image is formed based on the desired negative toner image data Dn on the charged photosensitive drum 61. In this case, the image data Dn is data for forming the negative toner image.

The electrostatic latent image formed on the photosensitive drum 61 is developed by the toner. This enables the desired negative toner image on the photosensitive drum 61 to be transferred on the belt member 66.

The first thermal transfer portion 306 transfers the desired negative foil image from the foil sheet 500 onto the belt member 66 based on a first thermal transfer signal S6. The first thermal transfer signal S6 is a signal for controlling temperature of the heater H1 and/or transfer pressure. The control portion 350 outputs the first thermal transfer signal S6 to the first thermal transfer portion 306.

The second thermal transfer portion 308 transfers the desired positive foil image remained on the foil sheet 500 on the desired positive toner image of the sheet of paper P based on a second thermal transfer signal S8. The second thermal transfer signal S8 is a signal for controlling temperature of the heater H2 and/or transfer pressure. The control portion 350 outputs the second thermal transfer signal S8 to the second thermal transfer portion 308.

The second detection portion 330 detects the reach of the sheet of paper P when performing the registration correction and outputs a sheet detection signal S33 obtained by this detection to the control portion 350. The first detection portion 360 detects the side of the side of the sheet of paper P following the registration correction and outputs a deflection detection signal S36 indicating an amount of deflection from the position of the side of the sheet of paper P up to the reference position to the control portion 350.

The adjustment portion 380 is composed of, for example, gears and a motor. The adjustment portion 380 move the registration rollers 328 nipping the sheet of paper P to the width direction D2 of the sheet of paper P based on a fluctuation control signal S38 (instruction values) output from the control portion 350. The fluctuation control signal S38 is generated to align the position of the side of the sheet of paper P with the side of the position of the foil sheet 500 based on the deflection detection signal S36. The alignment of the position of side of the sheet of paper P with the position of the side of the foil sheet 500 allows the desired positive foil image remained on the foil sheet 500 to be laid on the desired positive toner image of the sheet of paper P with good reproducibility.

The first driving portion 370 is composed of, for example, a stepping motor. The first driving portion 370 drives based on a motor driving signal S37 received from the control portion 350 to drive the roller constituting the second thermal transfer portion 308 and to allow the reel portion 304 to rotate together with the driving of this roller. In this embodiment, an encoder may be provided in a motor for driving the roller to control the winding speed of the reel portion 304. It is to be noted that the reel portion 304 may be configured so as to provide another driving portion other than the first driving portion 370 to drive the reel portion 304.

The second driving portion 374 is composed of, for example, a stepping motor. The second driving portion 374 drives based on a motor driving signal S74 received from the control portion 350 to drive, for example, the conveying rollers 314, 322, 324, 326, 328, the loop rollers 327 and the like provided on, for example, the conveying path R2 to rotate them.

The third driving portion 378 is composed of, for example, a stepping motor. The third driving portion 378 drives based on a motor driving signal S38 received from the control portion 350 to drive, for example, the conveying rollers 344, 346 and the like provided on the paper ejection path R3 to rotate them. Although the second driving portion 374 and the third driving portion 378 of the foil transferring apparatus 300 has been configured so as to drive plural rollers at the same time, this invention is not limited thereto: respective rollers may be independently driven.

The memory portion 340 is composed of, for example, a nonvolatile semiconductor memory, a hard disk drive (HDD) or the like. The memory portion 340 stores information D34 on the position of the side of the sheet of paper P. The memory portion 340 also stores the desired negative toner image data Dn for drawing the desired negative image which reverses the desired image (for example, the star image), in addition to the above-mentioned information D34. The memory portion 340 further stores information on the writing start position of the positive toner image obtained by the image forming apparatus 100, information on the writing start position of the negative toner image set by the negative toner image forming portion 60 and/or the like.

The communication portion 390 is composed of various kinds of interfaces such as network interface card (NIC), modulator-DEModulator (MODEM), universal serial bus (USB) and the like and performs an interactive communication between the foil transferring apparatus 300 and the image forming apparatus 100 or the finisher 400. In this embodiment, the communication portion 390 connects the image forming apparatus 100. The foil transferring apparatus 300 receives the above-mentioned image data Dn and information on the writing start position and the like from the image processing portion 140 of the image forming apparatus 100 through the communication portion 390. Thus, they constitute the control system of the foil transferring apparatus 300.

[Operation Example of Image Forming System #1]

Figure 8:
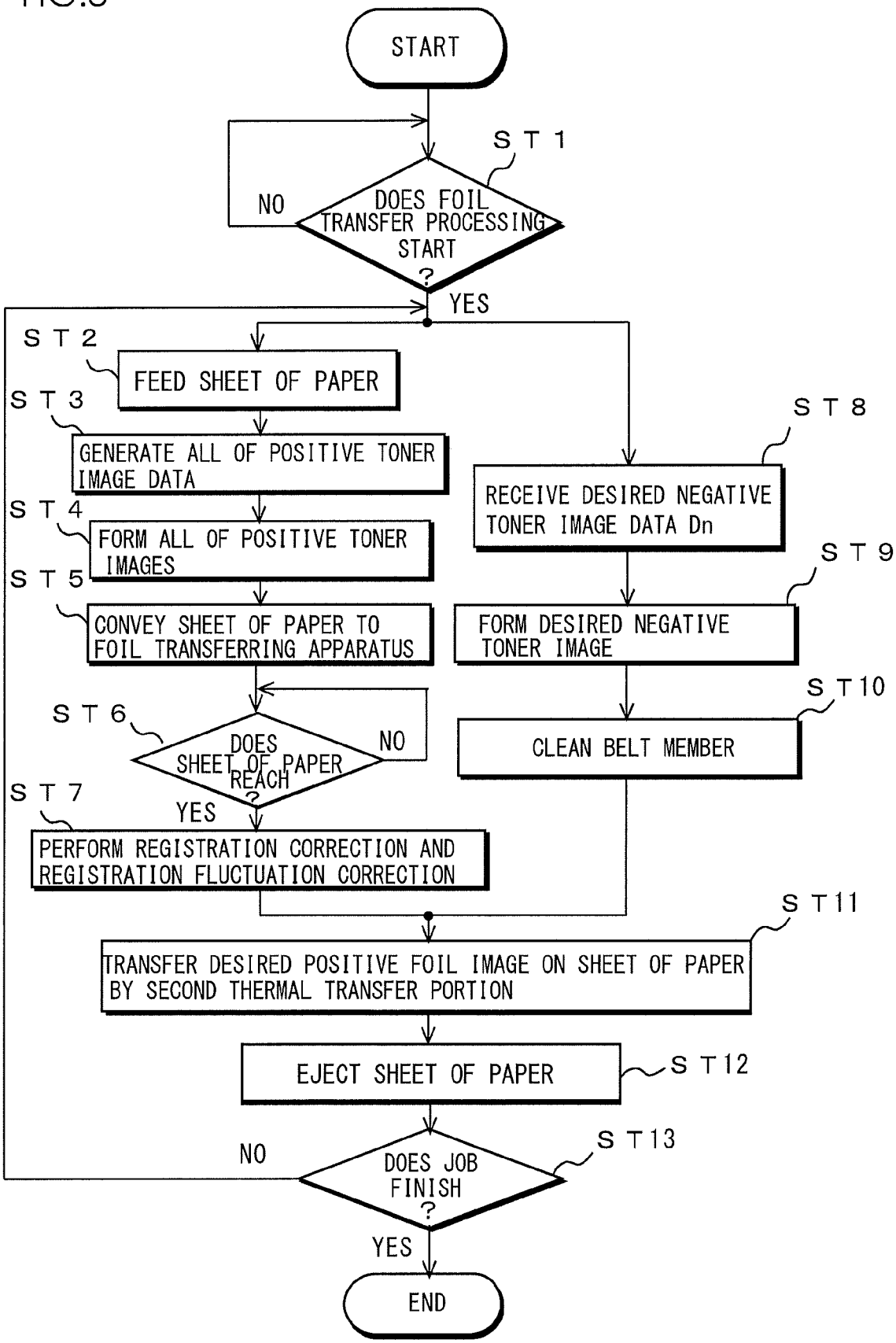
FIG. 8 is a flowchart showing an operation example of the image forming system #1.

The following will describe an operation example of the image forming system #1 during the foil transfer processing with reference to FIGS. 8 through 10. In the following description, a case where the feeding portion 20 of the image forming apparatus 100 feeds the sheet of paper P on which the images are formed will be described. In the image forming system #1, the control portion 150 of the image forming apparatus 100 controls the image forming portion 80 to form all the positive toner images based on the image data D on the sheet of paper P. At the same time, the control portion 350 of the foil transferring apparatus 300 controls the negative toner image forming portion 60 and the supplying portion 70 to form the desired positive foil image 504*a*, to be transferred, corresponding to the desired positive toner image.

In the image forming system #1, a user selects a foil-processing area, on which the foil is transferred, among all the images using the manipulation/display portion 160 or the like. Further, the image forming apparatus 100 outputs to the foil transferring apparatus 300 the desired negative toner image data Dn which reverses the desired positive toner image data relating to the selected foil-processing area. Additionally, both of the processing of forming all the positive toner images on the sheet of paper P and the processing of forming the desired positive foil image 504*a* corresponds to the desired positive toner image of the sheet of paper P on the foil sheet 500 are carried out in parallel.

Under these conditions, as shown in FIG. 8, at a step ST1, the control portion 150 determines whether or not the foil transfer processing is selected. For example, the control portion 150 determines whether or not a user specifies the foil-processing area for performing the foil transfer processing on the manipulation screen of the manipulation/display portion 160 or the user selects a button for starting the foil transfer processing. The control portion 150 may determine whether or not a computer connecting the image forming apparatus 100 via a network sends any information indicating a start of the foil transfer processing.

When selecting the foil transfer processing, a printing job including the image data Dn for performing the foil transfer processing and any information on sheet sizes and species of the sheet of paper P and the foil sheet 500 is supplied to the control portion 150 and the control portion 350. If it is determined that the foil transfer processing is not selected, then the control portion 150 waits until the foil transfer processing is selected.

If it is determined that the foil transfer processing is selected, then the control portion 150 goes to a step ST2. At the step ST2, the control portion 150 controls the feeding portion 20 to feed the sheet of paper P in the image forming apparatus 100. In this moment, the control portion 150 controls the feeding portion 20 to feed the sheet of paper P, which is set for forming the images, from the corresponding feeding tray and to convey it to the image forming portion 80.

Next, at a step ST3, the control portion 150 generates the image data D on yellow (Y), magenta (M), cyan (C) and black (BK) for forming all the positive toner images and any information indicating the writing start position of the images. The control portion 150 receives the image data D on the all the positive toner images from, for example, an outside personal computer and converts the image data of RGB system to image data D of YMCK system.

Figure 4B:
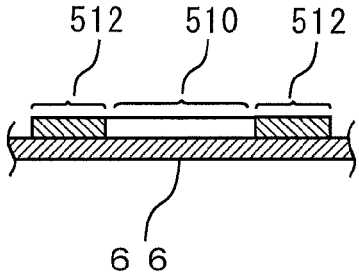

At a step ST4, the control portion 150 then allows forming all the positive toner images on the sheet of paper P based on the image data D. For example, when transferring a star shaped foil as shown in FIGS. 4A and 4B on the sheet of paper P on which the images have been formed, the image forming portion 80 forms all the toner images including the desired positive toner image 520, to be transferred, on the sheet of paper P. In the image forming portion 80, light-writing portions 3 each using a polygon mirror form electrostatic latent images based on the image data D on the photosensitive drums 1 which have been uniformly charged by the charging portions 2 corresponding to respective image forming colors.

The developing portions 4 corresponding to the respective image forming colors develop the electrostatic latent images. Such charge, exposure and development enables the color toner images formed on the photosensitive drums 1 to be transferred on the intermediate transfer belt 8 (primary transfer) by driving primary transfer rollers 7 corresponding to the photosensitive drums 1 for Y, M, C, BK colors. Respective color toner images transferred on the intermediate transfer belt 8 are put one another.

The secondary transfer portion 42 transfers the put color toner images on the sheet of paper P (secondary transfer). The fixing portion 44 fixes the color toner images transferred on the sheet of paper P. This enables all the color toner images based on the image data D to be formed on the sheet of paper P.

At the step ST5, the control portion 150 allows conveying the sheet of paper P on which the images have been formed to the foil transferring apparatus 300. In this moment, in the foil transferring apparatus 300, the control portion 350 controls the second driving portion 374 to drive based on the motor driving signal S74. This drive enables the conveying rollers 314, 322, 324 and 326 to be rotated. These rollers 314, 322, 324 and 326 convey the sheet of image-formed paper P conveyed from the image forming apparatus 100 to the second thermal transfer portion 308 through the conveying path R2.

At a step ST6, the control portion 350 determines whether or not the sheet of paper P reaches the registration correction position based on the detection of the second detection portion 330. If the sheet of paper P does not reach the registration correction position, then the second detection portion 330 continues to detect the reach of the sheet of paper P. In this moment, the control portion 350 determines whether or not the sheet of paper P reaches the registration correction position by a fact that the sheet detection signal S33 output from the second detection portion 330 changes from its high level to its low level.

If the sheet of paper P reaches the registration correction position, at a step ST7, the control portion 350 allows performing the registration correction. In this moment, the control portion 350 controls the registration rollers 328 to stop and controls the loop rollers 327 to hit a forward end of the sheet of paper P conveyed on the conveying path R2 against the stopped registration rollers 328 to form a loop. This enables the registration correction for correcting the deflection of the sheet of paper P to be performed.

The control portion 350 also allows performing the registration fluctuation correction when finishing the registration correction. Specifically, the control portion 350 reads the information D34 on the position of the side of the foil sheet 500 as the reference position and the information D34 on the position of the side of the sheet of paper P detected by the first detection portion 360 from the memory portion 340. The control portion 350 calculated a difference between the information D34 on the position of the side of the foil sheet 500 and the information D34 on the position of the side of the sheet of paper P and calculates an amount of positional skew (or an amount of deviation) of the sheet of paper P along the width direction D2 of the sheet of paper P with respect to the foil sheet 500.

The control portion 350 generates an instruction value based on the calculated amount of positional skew and outputs it to the adjustment portion 380. The control portion 350 controls the adjustment portion 380 to drive so that the registration rollers 328 move to the width direction D2 of the sheet of paper P based on the instruction value. This allows the desired positive toner image of the sheet of paper P to be aligned with the desired positive foil image remained on the foil sheet 500.

On the other hand, in parallel with the above-mentioned steps ST2 through ST7, the foil transferring apparatus 300 first receives the desired negative toner image data Dn for forming the desired negative toner image. The image data Dn for forming the desired negative toner image is data on the image which reverses the desired positive toner image such as the star image to be transferred. The foil transferring apparatus 300 receives the image data Dn for forming the desired negative toner image from the image processing portion 140 of the image forming apparatus 100 through the communication portion 390.

At a step ST9, the control portion 350 controls the negative toner image forming portion 60 and the first thermal transfer portion 306 to form the desired negative toner image 512 on the photosensitive drum 61 based on the image forming signal S60 and the desired negative toner image data Dn. The desired negative toner image 512 is then transferred on the belt member 66 (see FIGS. 4A and 4B).

In the negative toner image forming portion 60, the charging portion 63 charges the photosensitive drum 61 to a predetermined potential. The exposing portion 64 forms the electrostatic latent image based on the desired negative toner image data Dn on the charged photosensitive drum 61. In this moment, a writing start position of the desired negative toner image is set so that the desired positive foil image remained on the foil sheet 500 can be transferred on the desired positive toner image of the sheet of paper P at a target position to align the desired positive toner image of the sheet of paper P with the desired positive foil image. The desired negative toner image is written from left side end of the photosensitive drum 61 along a main scanning direction in order to set a single side of the foil sheet 500 (for example, a left end side of the sheet-conveying direction) as the reference position. In this moment, the desired negative toner image data Dn is the data for drawing the desired negative toner image which reverses the star foil image.

The developing portion 65 develops the electrostatic latent image formed on the photosensitive drum 61 based on the image forming signal S60. In this moment, toner adheres to the electrostatic latent image so that the electrostatic latent image can be developed. The photosensitive drum 61 rotates clockwise and the belt member 66 rotates counterclockwise. This enables the desired negative toner image to be transferred on the belt member 66.

Further, the control portion 350 controls the negative toner image forming portion 60 and the supplying portion 70 to convey the foil sheet 500 from the first thermal transfer portion 306 to the second thermal transfer portion 308 while the desired negative foil image is transferred to the desired negative toner image on the belt member 66. In this moment, the control portion 350 controls the supplying portion 70 to drive the first driving portion 370 based on the motor driving signal S37 and controls the reel portion 304 to wind the foil sheet 500 drawn out of the winding portion 302.

The control portion 350 controls the first thermal transfer portion 306 to lay the foil layer 504 of the foil sheet 500 on top of a surface of the belt member 66 on which the desired negative toner image is transferred, to heat and pressure them. Thus, the desired negative foil image 504*c* is transferred onto the desired negative toner image on the surface of the belt member 66 using fusing action of the toner image by thermo fusion. This enables the desired positive foil image corresponding to the desired positive toner image to remain on the foil sheet 500.

Figures 9A, 9B, 9C, 9D:
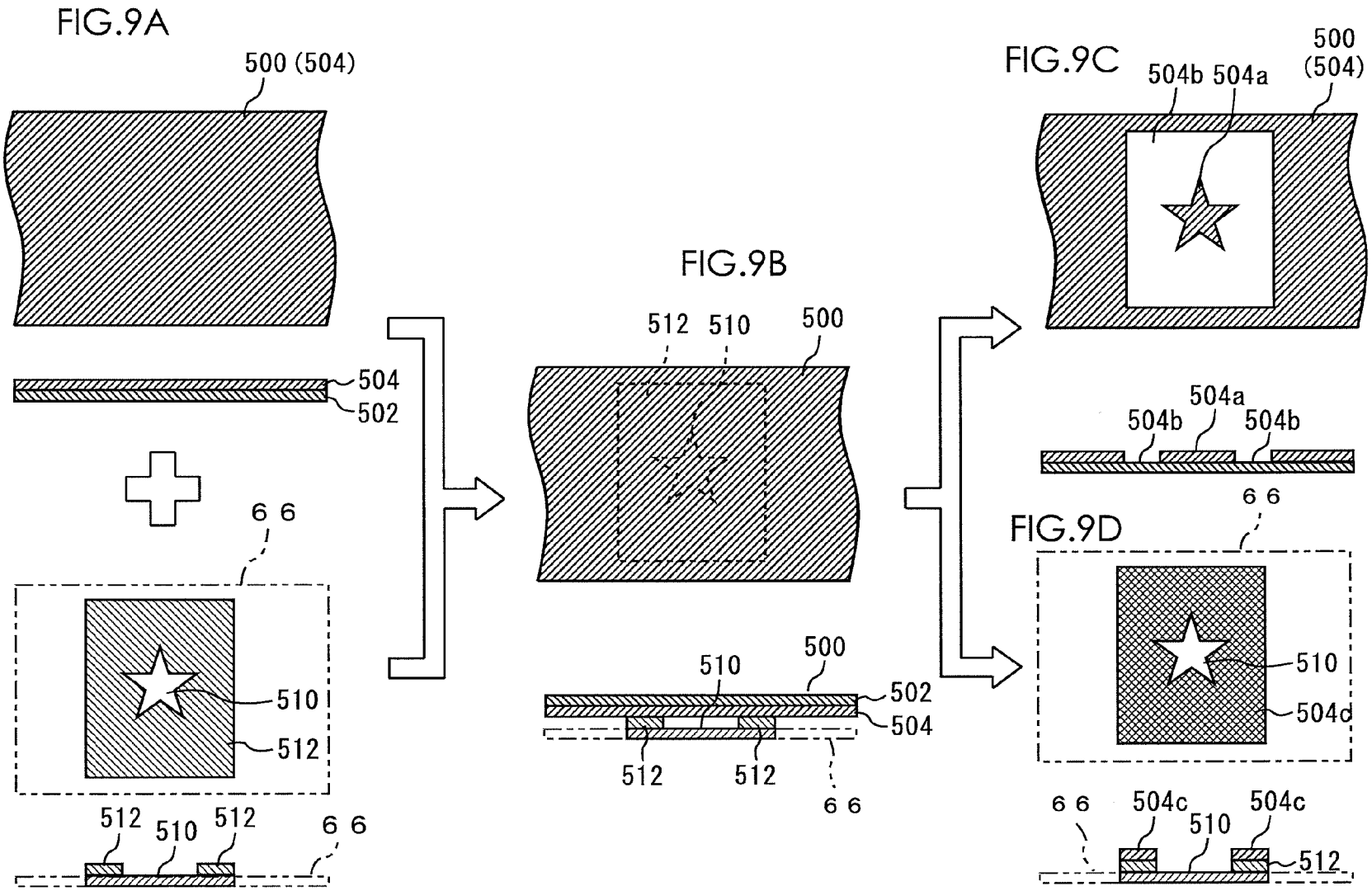
FIGS. 9A through 9D are diagrams showing a case where the negative foil image is transferred from the foil sheet 500 onto the belt member 66.

Specifically, as shown in FIGS. 9A and 9B, the foil layer 504 of the foil sheet 500 is laid on top of a surface of the belt member 66 on which the desired negative toner image 512, and they are heated and pressured. This enables the desired negative foil image 504*c* other than the desired positive foil image 504*a*, as shown in FIG. 9D, to be transferred on the desired negative toner image 512 of the belt member 66. On the other hand, the desired positive foil image 504*a* remains on the foil layer 504 of the foil sheet 500, as shown in FIG. 9C, of star image to be transferred on the sheet of image-formed paper P and the recessed portion 504*b* from which the desired negative foil image is transferred onto the belt member 66 is formed. At a step ST10, the cleaning portion 67 cleans the desired negative toner image on the belt member 66 and the desired negative foil image adhered to the desired negative toner image.

At a step ST11, the control portion 350 controls the second thermal transfer portion 308 to transfer the foil layer 504 corresponding to the desired positive foil image remained on the foil sheet 500 on the desired positive toner image of the sheet of paper P. In this embodiment, the foil layer 504 corresponding to the desired positive foil image of start image is transferred onto the desired positive toner image of star image of the sheet of paper P.

The control portion 350 compares the information on the writing start position of the image in the image forming apparatus 100 with the information on the writing start position of the desired negative toner image set by the negative toner image forming portion 60. The control portion 350 calculates timing to meet pieces of the information on both of the writing start positions to each other. In this embodiment, the control portion 350 calculates time when the desired positive foil image remained on the foil image 500 reaches the second thermal transfer portion 308 from time when starting conveying the foil sheet 500 from the first thermal transfer portion 306. For example, the control portion 350 calculates the time when the desired positive foil image remained on the foil image 500 reaches the second thermal transfer portion 308 based on the conveying speed of the foil sheet, a conveying distance between the first and second thermal transfer portions 306 and 308 and the like.

The control portion 350 controls conveying start timing of the registration rollers 328 so that the sheet of paper P on which the images have been formed can be conveyed to the second thermal transfer portion 308 at the time when the desired positive foil image remained on the foil image 500 reaches the second thermal transfer portion 308. The control portion 350 allows transferring the desired positive foil image on the desired positive toner image of the sheet of paper P by laying the foil layer 504 of the foil sheet 500 on the top of a surface of the sheet of paper P in the second thermal transfer portion 308 and heating and pressuring them.

Figures 10A, 10B, 10C, 10D:
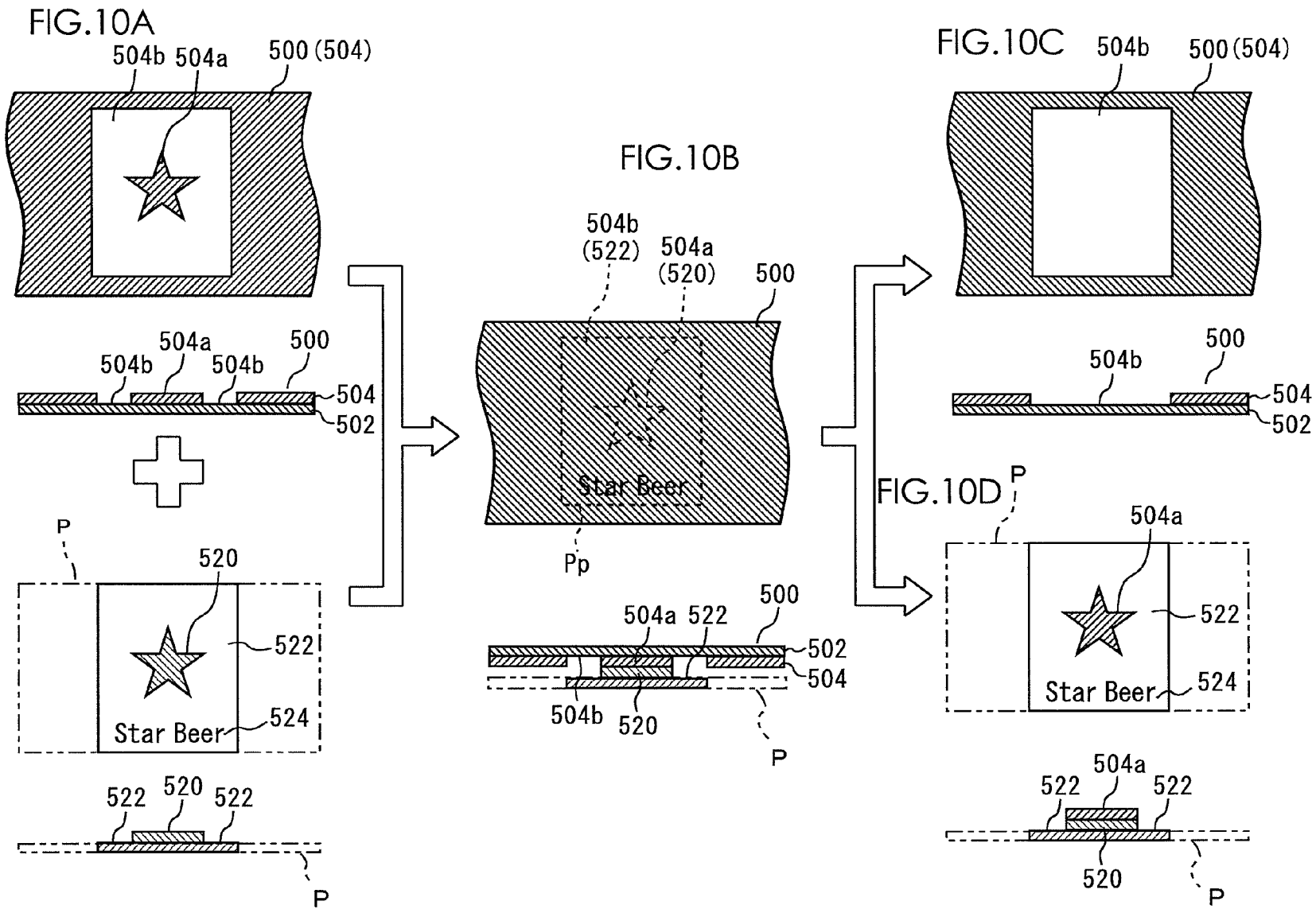
FIGS. 10A through 10D are diagrams showing a case where the positive foil image is transferred from the foil sheet 500 onto the sheet of paper P.

Specifically, as shown in FIGS. 10A and 10B, the foil layer 504 of the foil sheet 500 is laid on top of a surface of the sheet of image-formed paper P on which all the toner images are transferred, and they are heated and pressured. This enables the desired positive foil image 504*a* of start image remained on the foil sheet 500, as shown in FIG. 10D, to be transferred on the desired positive toner image 520 of the sheet of paper P.

No foil is transferred on the toner images of the characters 524 of "Star Beer" as design image, which have been transferred on the printing sheet of paper P, because these characters are positioned at positions corresponding to the recessed portion 504*b* of the foil sheet 500. On the other hand, as shown in FIG. 10C, the desired positive foil image 504*a* of star image is removed from the base member 502 so that in the foil layer 504 of the foil sheet 500, the recessed portion 504*b* is formed.

At a step ST12, when finishing the transfer of the desired positive foil image 504*a* on the sheet of paper P, the control portion 350 allows ejecting the sheet of foil-transferred paper P. In this moment, the control portion 350 controls the third driving portion 378 to drive based on the motor driving signal S38. The rotations of the conveying rollers 344 and 346 by this driving enable the sheet of foil-transferred paper P in the second thermal transfer portion 308 to be ejected to the finisher 400 through the exit 362. Such a foil transfer processing also enables the desired positive foil image to be transferred on the desired positive toner image of the sheet of image-formed paper P.

At a step ST13, the control portion 350 determines whether or not the foil transfer processing finishes. The control portion 350 determines whether or not the printing job finishes. For example, the control portion 350 determines it based on whether or not a predetermined number of sheets of paper P set in the setting of the foil transfer processing are ejected.

If it is determined that the printing job finishes, then the control portion 350 finishes the image forming processing relating to a series of foil transfer processing. On the other hand, if it is determined that the printing job does not finish, then the control portion 350 goes back to the steps ST2 or ST8 where the above-mentioned image forming processing and the foil transfer processing are repeatedly carried out in parallel.

As described above, according to the foil transferring apparatus 300 as this embodiment, since the negative toner image forming portion 60 in which the desired negative toner image 512 is formed on the belt member 66 via the photosensitive drum 61, the desired negative foil image 504*b* is transferred and remove from the foil sheet 500, and the desired positive foil image 504*a* remains on the foil sheet 500 is provided, it is possible to transfer the desired positive foil image 504*a* on the desired positive toner image 520 of the sheet of paper P with high accuracy. Further, since the cleaning portion 67 cleans and removes the desired negative toner image 512 and the desired negative foil images 504*c* from the belt member 66, the belt member can be repeatedly used. Because it is not necessary for the waste paper to be used, it is possible to save any waste sheets of paper P as compared with a method of transferring the desired negative toner image on the sheet of paper P and discarding the same.

Further, according to the image forming system #1 using the foil transferring apparatus 300 as this embodiment, it is possible to provide an environment-friendly the image forming system by which the foil transfer processing can be performed without using any paper resources wastefully.

Additionally, according to the image forming system #1 of this embodiment, since both of the processing for controlling the image forming portion 80 to form all the positive toner images on the sheet of paper P and the processing for controlling the negative toner image forming portion 60 and the supplying portion 70 to form the desired positive foil image on the foil sheet 500 can be performed in parallel, it is possible to perform the foil transfer processing in a shorter processing time as compared with a method of transferring the desired negative toner image on the waste paper and removing unnecessary negative foil image from the foil sheet. Accordingly, it is possible to perform the foil printing efficiently and continuously, which increases the productivity in the image forming system #1.

When any design images such as characters 524 of "Star Beer" are previously formed on the sheet of image-formed paper P, it is possible to transfer the desired positive foil image on the foil processing area with high accuracy without the foil transferring on the designs. This enables the foil to be transferred rapidly and continuously, which increases the productivity thereof.

Although the present invention has been described with reference to the embodiments above, it is to be noted that the present invention is not limited to the embodiments, and various changes and modifications are possible to those who are skilled in the art insofar as they are within the scope of the invention. For example, although in the above-mentioned embodiments, the foil image to be transferred on the sheet of paper P on which the images are formed has been star image, this invention is not limited thereto: Another image other than the star image can be adapted.

Although in the above-mentioned embodiments, the characters 524 as the design images which are transferred on the printing sheet of paper Pp have been illustrated, this invention is not limited thereto: A design image such as other sign and/or device can be utilized.

Although in the above-mentioned embodiments, the second and third driving portions 374, 378 of the foil transferring apparatus 300 have been described for convenience so as to have such a configuration that plural rollers are driven at the same time, this invention is not limited thereto: Respective rollers may be separately driven.

It should be understood by those skilled in the art that various modifications, combinations, sub-combinations and alterations may occur depending on design requirements and other factors insofar as they are within the scope of the appended claims or the equivalents thereof.

What is claimed is:

1. A foil transferring apparatus that transfers a desired positive foil image on a desired positive toner image selected among all the toner images formed on base material, the apparatus comprising:

a negative toner image forming portion that includes a photosensitive drum and an image supporting member, the negative toner image forming portion forming a desired negative toner image that reverses the desired positive toner image on the photosensitive drum and transferring the desired negative toner image formed on the photosensitive drum onto the image supporting member;

a supplying portion that supplies a foil sheet having a foil layer on a surface thereof to the negative toner image forming portion;

a conveying path on which the foil sheet is conveyed;

a first transfer portion that transfers a desired negative foil image from the foil sheet to the image supporting member, the first transfer portion being positioned at an upstream side of the conveying path;

a second transfer portion that transfers a desired positive foil image remained on the foil sheet onto the desired positive toner image formed on the base material, the second transfer portion being positioned at a downstream side of the conveying path; and a cleaning portion that removes the desired negative toner image and the desired negative foil image from the image supporting member.

2. The foil transferring apparatus according to claim 1 wherein the first transfer portion is a first thermal transfer portion and the second transfer portion is a second thermal transfer portion.

3. The foil transferring apparatus according to claim 1 wherein the negative toner image forming portion further includes:

a charging portion that charges the photosensitive drum with electricity;

an exposing portion that forms a desired negative electrostatic latent image on the photosensitive drum charged by the charging portion;

a developing portion that develops the desired negative electrostatic latent image formed on the photosensitive drum by the exposing portion to form the desired negative toner image; and a negative toner image transferring portion that transfers the desired negative toner image from the photosensitive drum to the image supporting portion.

4. The foil transferring apparatus according to claim 1 wherein the supplying portion comprises:

a winding portion on which the foil sheet is wound like a roll;

a reel portion that winds the foil sheet drawn out of the winding portion; and a driving portion that drives the reel portion.

5. The foil transferring apparatus according to claim 1 wherein the image supporting member is a belt member.

6. The foil transferring apparatus according to claim 1 further comprising a manipulation/display portion that is configured so as to select a foil processing area for selecting the desired positive toner image on which the desired positive foil image is transferred among all the toner images formed on the base material.

7. The foil transferring apparatus according to claim 1 further comprising a control portion that is configured so as to convey the foil sheet and the base material to the second transfer portion to align the desired positive toner image on the base material with the desired positive foil image on the foil sheet.

8. The foil transferring apparatus according to claim 7 further comprising registration rollers that move to a width direction of the base material with the base material being nipped, wherein the control portion controls the registration rollers to correct a deviation amount of a position of an end of the base material deviated from a reference position by moving the registration rollers so that the desired positive toner image on the base material is aligned with the desired positive foil image on the foil sheet.

9. The foil transferring apparatus according to claim 1 further comprising a manipulation/display portion that is configured so as to set an image relating to a foil processing area in which the foil is transferred onto the image selected among all the images.

10. An image forming system which forms a desired positive foil image on a desired positive toner image selected among all the toner images formed on base material, the system comprising:

an image forming apparatus that forms all the toner images on the base material; and a foil transferring apparatus that transfers the desired positive foil image on the desired positive toner image selected among all the toner images formed on the base material by the image forming apparatus, the foil transferring apparatus including:

a negative toner image forming portion that includes a photosensitive drum and an image supporting member, the negative toner image forming portion forming a desired negative toner image that reverses the desired positive toner image on the photosensitive drum and transferring the desired negative toner image formed on the photosensitive drum onto the image supporting member;

a supplying portion that supplies a foil sheet having a foil layer on a surface thereof to the negative toner image forming portion;

a conveying path on which the foil sheet is conveyed;

a first transfer portion that transfers a desired negative foil image from the foil sheet to the image supporting member, the first transfer portion being positioned at an upstream side of the conveying path;

a second transfer portion that transfers a desired positive foil image remained on the foil sheet onto the desired positive toner image formed on the base material, the second transfer portion being positioned at a downstream side of the conveying path; and a cleaning portion that removes the desired negative toner image and the desired negative foil image from the image supporting member.

11. The image forming system according to claim 10 wherein the image forming apparatus contains:

an image forming portion that includes a photosensitive drum, the image forming portion forming all the toner images on the photosensitive drum; and a toner image transferring portion that transfers all the toner images formed on the photosensitive drum onto the base material.

12. The image forming system according to claim 10 wherein the image forming apparatus includes an image processing portion that supplies to the negative toner image forming portion image data for forming the desired negative toner image, which reverses the desired positive toner image selected, selected among the image data for forming all the toner images.

13. The image forming system according to claim 10 wherein the first transfer portion is a first thermal transfer portion and the second transfer portion is a second thermal transfer portion.

14. The image forming system according to claim 10 wherein the negative toner image forming portion further includes:

a charging portion that charges the photosensitive drum with electricity;

an exposing portion that forms a desired negative electrostatic latent image on the photosensitive drum charged by the charging portion;

a developing portion that develops the desired negative electrostatic latent image formed on the photosensitive drum by the exposing portion to form the desired negative toner image; and a negative toner image transferring portion that transfers the desired negative toner image from the photosensitive drum to the image supporting portion.

15. The image forming system according to claim 10 wherein the supplying portion comprises:

a winding portion on which the foil sheet is wound like a roll;

a reel portion that winds the foil sheet drawn out of the winding portion; and a driving portion that drives the reel portion.

16. The image forming system according to claim 10 wherein the image supporting member is a belt member.

17. The image forming system according to claim 10 further comprising a manipulation/display portion that is configured so as to select a foil processing area for selecting the desired positive toner image on which the desired positive foil image is transferred among all the toner images formed on the base material.

18. The image forming system according to claim 10 further comprising a control portion that is configured so as to convey the foil sheet and the base material to the second transfer portion to align the desired positive toner image on the base material with the desired positive foil image on the foil sheet.

19. The image forming system according to claim 18 further comprising registration rollers that move to a width direction of the base material with the base material being nipped, wherein the control portion controls the registration rollers to correct a deviation amount of a position of an end of the base material deviated from a reference position by moving the registration rollers so that the desired positive toner image on the base material is aligned with the desired positive foil image on the foil sheet.

20. The image forming system according to claim 10 further comprising a manipulation/display portion that is configured so as to set an image relating to a foil processing area in which the foil is transferred onto the image selected among all the images.

* * * * *